United States Patent [19]

Baxter

[11] Patent Number: 4,932,792

[45] Date of Patent: Jun. 12, 1990

[54] ANTI-REBOUND DEVICE FOR DRAWER SLIDES

[75] Inventor: Alan R. Baxter, Waterloo, Canada

[73] Assignee: Waterloo Metal Stampings Ltd., Ontario, Canada

[21] Appl. No.: 248,898

[22] Filed: Sep. 23, 1988

[30] Foreign Application Priority Data

Jun. 13, 1988 [CA] Canada ..... 569313

[51] Int. Cl.[5] ..... A47B 88/00

[52] U.S. Cl. ..... 384/18; 312/348; 384/20

[58] Field of Search ..... 384/18–23; 312/333, 341, 348

[56] References Cited

U.S. PATENT DOCUMENTS 1,537,067 5/1925 Card .
3,074,766 1/1963 Meyer ..... 384/18
4,469,384 9/1984 Fler et al. ..... 384/18 X
4,537,450 8/1985 Baxter ..... 384/18
4,696,582 9/1987 Kasten ..... 384/18

*Primary Examiner*—Thomas R. Hannon
*Attorney, Agent, or Firm*—Fish & Richardson

[57] ABSTRACT

In file cabinets and drawer storage assemblies, where drawer slides are employed, a unique anti-rebound device not only cushions and resists rapid closure of a drawer but also resists reopening of the drawer by rebound. The slippage outward of the drawers when the cabinet is moved out of a vertical position is also eliminated, except when an external force is applied to pull open the drawer. The unique elongate anti-rebound member has resilient sides which deflect when engaged by two protruding lugs on the inner channel of the drawer slide. The device fits onto an end flange of the outer channel and is positioned between the intermediate and inner channels so that no loss of space or strength occurs.

8 Claims, 3 Drawing Sheets

ANTI-REBOUND DEVICE FOR DRAWER SLIDES

DESCRIPTION OF THE INVENTION

This invention relates to drawer slide supports or suspensions of the extendible type used in file cabinets and other types of furniture which employ sliding devices. More particularly, the invention relates to drawer sliding devices for filing cabinets which use full extension slides.

DESCRIPTION OF THE PRIOR ART

Drawer slides in filing cabinets must be precisionly made and function effortlessly with a minimum amount of friction. It is necessary that such drawer slides support heavy loads of paper, or other items. File cabinet drawer slides must enable the user to fully extend the drawer from the cabinet in order to easily examine all the documents or paper therein. Drawer slides should also be sequenced in their closure and opening in order to avoid wear on the parts of the slides and permit easy operation. Lastly, file cabinet makers require drawer slides which take up the minimum amount of space in the cabinet.

In order to satisfy the need for compact, almost frictionless, strong, long-lasting drawer slides, three part slide drawers with ball bearings have been invented. Such slides are disclosed in U.S. Pat. Nos. 4,537,450 and 4,469,384 as well as Canadian patent No. 1,125,346.

The first refinement in such drawer slides was to employ bumpers constructed of long-lasting plastics and particularly polymerized resins within the slide. These bumpers prevent wear and alleviated noise when file drawers were shut. Such bumpers must withstand at least 75,000 closings and show only minimal wear.

Secondly, latch-type devices, constructed from similar types of plastic materials, were devised to latch onto protrusions in the slide for the purpose of keeping the drawer closed. This is particularly important when file cabinets are located on uneven surfaces as the cabinets are not vertical.

One problem which remains in the art, is that of rebound of the file drawer when it is pushed quickly shut. Often file drawers are slammed shut and reopen, particularly when file cabinets are not perfectly vertically balanced. An anti-rebound device is needed not only to cushion the closing of the file drawers but also to keep them closed once the file drawer reaches the closed position. This is particularly important when using an interlock system wherein all drawers must be completely closed in order to open another selected drawer. Moreover, an anti-rebound device must not sacrifice the requirements for compact frictionless strong long-lasting three piece slides.

Some anti-rebound devices have been incorporated into drawer slides but none have proved effective for accomplishing these requirements. In U.S. Pat. No. 1,537,067 wire protrusions sticking outwards from each side of an intermediate slide come to rest against protrusions located on the outer slide and inner slide. One problem with such a device is that it does not have a long life and its capacity does not meet modern standards. A more serious drawback is that it takes up too much space for the compact modern drawer slides, as the structural tolerances in the construction of drawers and cabinets are very small.

BACKGROUND OF THE INVENTION

A more recent anti-rebound drawer device is produced by the Anchor Slide Company of Holland. It employs a bumper, cam and spring mounted on the inside of the outer channel. The problem with this device is that it is expensive to produce and takes up a great deal of space. The intermediate slide must be shortened to allow for the mechanism to be inserted and the base slide must be lengthened in order for the drawer to be opened the same distance when an anti-rebound device is not present. This is a problem for cabinet makers. In order to pull the drawer out to its fully extended position, extra wasted depth of the cabinet is needed, i.e. cabinets must be constructed approximately three inches deeper. Moreover, when the intermediate slide channel is shortened, the load supporting capacity is greatly lessened.

There is therefore a need to provide an anti-rebound device, for use with conventional modern three part slides which does not require any additional space in the cabinet.

There is a further need to provide a three part drawer slide with an anti-rebound device which is long-lasting but does not sacrifice strength and support.

Finally there is a need to provide a three part drawer slide which can employ either a latching device or an anti-rebound device, according to the user's needs.

SUMMARY OF THE INVENTION

Therefore, this invention seeks to provide a drawer slide comprising at least two slide channels and a resiliently deflectable anti-rebound means; said slide channels having flanged sides and being adapted to slide one within another; two of said slide channels having at least one projection or fastening means near adjacent ends; wherein in operation, said anti-rebound means which is mounted on a projection or fastening means of one slide channel lies in the same plane as the web of said slide channels, and is adapted to engage and be resiliently deflected by at least one projection of said second slide channel, such that When said drawer slide moves between an open position and a closed position said anti-rebound means resists both closure and reopening.

In a preferred embodiment, the invention seeks to provide a drawer slide comprising an inner slide channel, an intermediate slide channel, an outer base slide channel, and an anti-rebound means; including a substantially 90° upturned flange member or fastening means at one end of said base slide upon which said anti-rebound means is mounted, and two substantially 90° downturned projections near the adjacent end of said inner slide channel; wherein, in operation, said two downturned projections are adapted to engage and resiliently deflect said anti-rebound means upon closing and reopening said drawer slide.

The invention also seeks to provide a drawer slide wherein said anti-rebound means comprises an elongate member having resilient sides which converge from one end to a point of maximum width, said end having a mounting means to mount said anti-rebound means on said upturned flange member or said fastening means, and thereafter said resilent sides diverge towards a tapered opposite end; said tapered opposite end adapted to engage said two downturned projections on another slide channel.

In the present invention, the elongated anti-rebound device is simply constructed out of polymerized resins and is extremely resilient and long-wearing. It meets the requirements of the *Business Institute of Furniture Manufacturers' Association.* This Association sets standards for safety performance for such articles as filing cabinets. They require the drawer slides to open and close 75,000 cycles in order to meet such standards.

In a preferred embodiment a flange at one end of the outer base channel of a three channel drawer slide is turned upwards about 90° in the same direction as the side flanges of the channel. The anti-rebound device has a slot in the rear end which fits over this flange. The anti-rebound device is positioned in parallel relationship with the side flanges of the base channel, above the intermediate flange, within the inner channel. This permits the intermediate channel slide, to close completely i.e. to abut the lower portion of the same upturned end flange when the drawer slide is in the closed position.

In operation the inner slide channel is attached to the drawer of a filing cabinet. Two lance tabs positioned in a line transverse to the longitudinal axis of the inner channel slide are turned at 90° angles in the direction of the outer and intermediate slide channels. That is to say the lance tabs protrude in the same direction as the side flanges of the inner drawer slide. These lance tabs are adapted to engage the front end of the anti-rebound device.

The preferred anti-rebound device is an elongate member with a tapered front end, and squared rear end. Its curvilinear resilent sides with specially developed different sectional sizes along the length of the sides of the anti-rebound device produces a low stress load. These sides can be compressed to a width similar to the distance between the two lance tabs.

The resilient sides of the anti-rebound device are squeezed inwardly when the drawer is closed by an external force, thereby offering resistance to closure. The maximum resistance occurs when the two lance tabs are positioned at the maximum width of the anti-rebound device's sides. After the point of maximum width passes the lance tabs, the resistance to closure lessens to a point where the anti-rebound device tends to pull the drawer inwards to a final closed position.

In the event that the drawer is closed with excessive force, the anti-rebound device will cushion the closure. When the inner slide reaches the end of its path and abuts the end of the base slide, the drawer will tend to rebound because of the hitting action. This will be prohibited as the two lance tabs of the inner slide will cause greater resistance as the mid point of the anti-rebound device reapproaches them. Thus, the drawer will tend to be again pulled back to the full closure position.

By positioning the device within the inner slide and above the intermediate slide, no loss of space or decrease in support or suspension will occur.

In an alternate embodiment, the same slide can be used with a latching device which replaces the rebound device. It is mounted on the 2 vertical projections on the small channel and adapted to receive the end flange of the large channel.

To further enhance and increase the energy absorbing capabilities of the anti-rebound device, and to better cope with the excessive closing forces caused by drawers in filing cabinets being slammed shut, an additional mechanism is included in this invention to improve its energy absorbing ability.

The bumpers on drawer slide channel sections, used to limit drawer travel are constructed of resilient plastic material. This softness or plasticity of this material is chosen because of its energy absorbing characteristics and its ability to deform without noise. By further modifying these bumpers, this inherent ability to deform silently can be used to slow the travel of the drawer to its outward stops and inward stop tabs.

The plastic bumper material is placed so that at certain times when travel in slide channels occurs, additional metal projections cause the plastic bumper material to deform, prior to the final collision with the stopping tabs. This initial friction and deformation with the bumper material causes a slowing of the drawer mechanism movement, reducing the final impact with the stopping bumper surfaces.

BRIEF DESCRIPTION OF THE DRAWINGS

The invention is described in more detail in conjunction with the following drawings wherein.

DETAILED DESCRIPTION OF THE DRAWINGS

Figure 1:
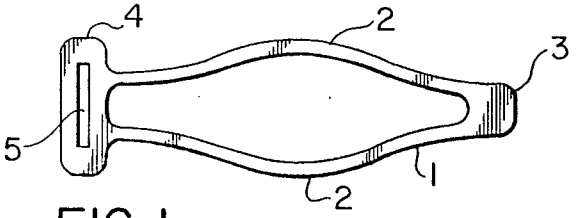
FIG. 1 is a perspective view of the anti-rebound device.

FIG. 1 is a perspective view of the anti-rebound device 1. It is an elongate member having resilient curvilinear sides 2 a tapered front end 3, and a squared or blunted rear end 4. A slotted aperture 5 which is transverse to the longitudinal axis of the anti-rebound device 1 is located in the rear end. The sides 2 have specially developed sectional sizing which decreases in size in both directions from the approximate midpoint of the sides of the anti-rebound device.

Figure 2:
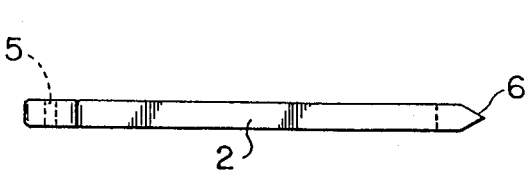
FIG. 2 is a side view of the anti-rebound device.

FIG. 2 is a side view of the anti-rebound device. One notes that the top and bottom are completely parallel. The device is of even thickness except for the tapered pointed front 6.

Figure 3:
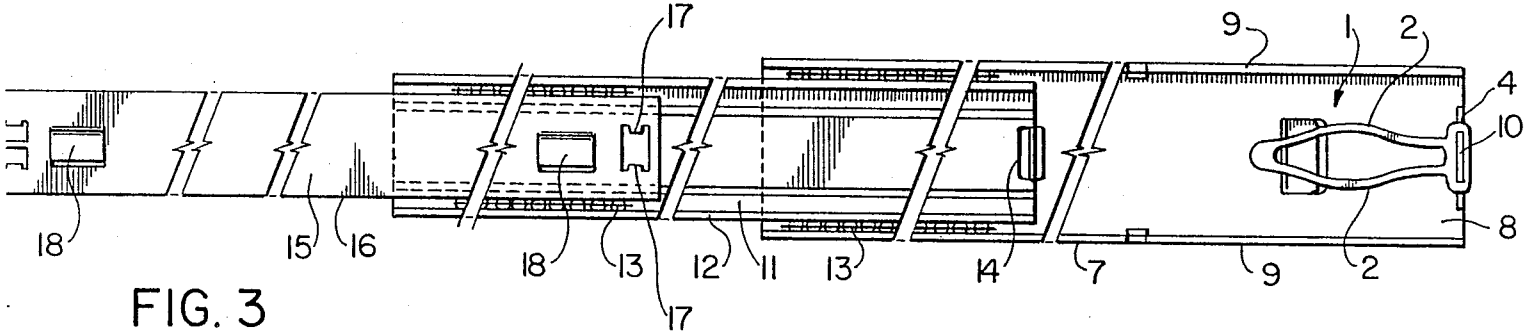
FIG. 3 is a top view of a three piece drawer slide in an open position having an anti-rebound device mounted thereon.

FIG. 3 is a top view of a drawer slide 7. It includes an outer base slide channel 8 which in operation is attached to the cabinet (not shown). The outer channel has upturned side flanges 9. An end flange 10 projects upwards at 90° and is used to mount the anti-rebound device 1. There is also an intermediate slide channel 11 with upturned side flanges 12. The intermediate slide channel 11 fits within the outer base channel 8 and has its flanges upturned in the same direction. Ball bearings 13 facilitate movement of the intermediate slide channel 11 within the outer base slide channel 8. Urethane cushion stops 14 are used to decrease wear and noise.

The narrowest channel 15, known as the inner slide channel attaches to the drawer of the cabinet (not shown). It has downturned side flanges 16. Near one end of the inner slide channel adjacent to the end of the outer base channel which has the upturned flange 9, are two downwardly directed lance tabs 17. Projections 18 are used to attach the slide to the drawer in the cabinet. Projections or pins can be used to deflect the anti-rebound device but the preferred embodiment is to press form lance tabs out of the inner channel 15. The lance tabs 17 are smoothed on their inner sides to avoid any wear on the anti-rebound device.

Figure 3A:
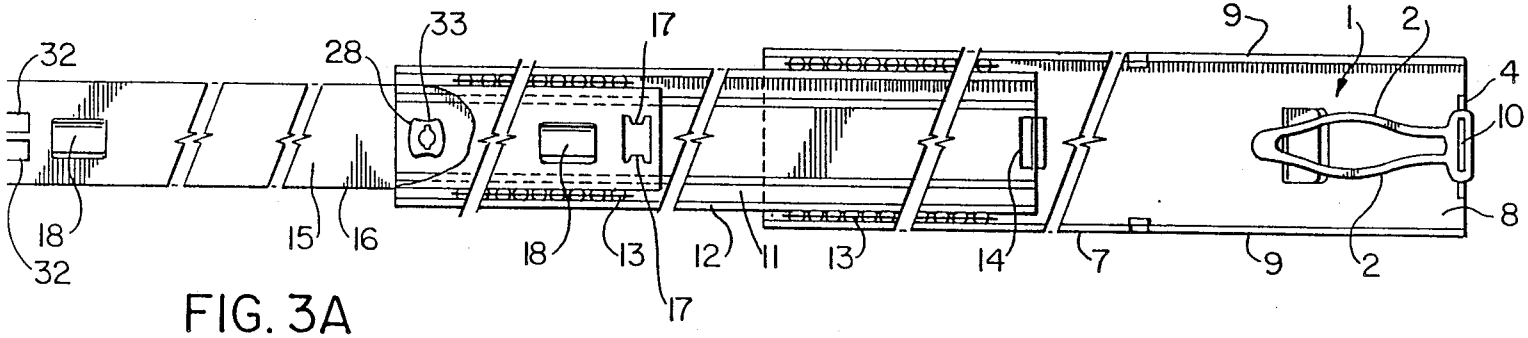
FIG. 3*a* is another top view of the same slide showing other details.

FIG. 3*a* is another top view of a three part drawer slide in an open position. The energy absorbing bumper 28 is mounted on a standing lance tab—33 on intermediate channel 11. This bumper device is similar and may be the same as the urethane cushion stops 14, on opposite end of intermediate slide channel 11.

Figure 4:
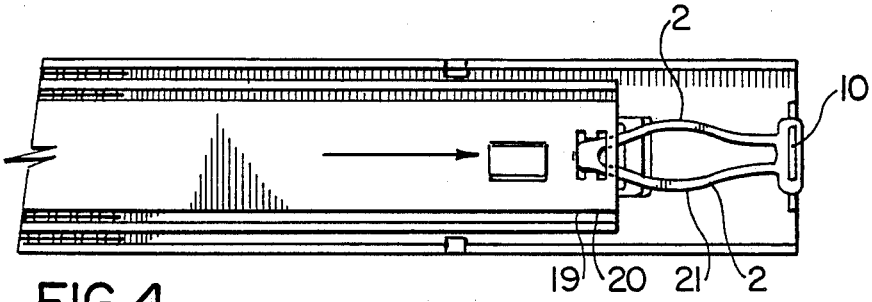
FIG. 4 is a top view of a three part slide during the closure wherein the tapered end of the anti-rebound device has entered between the projections on the inner slide.
Figure 5:
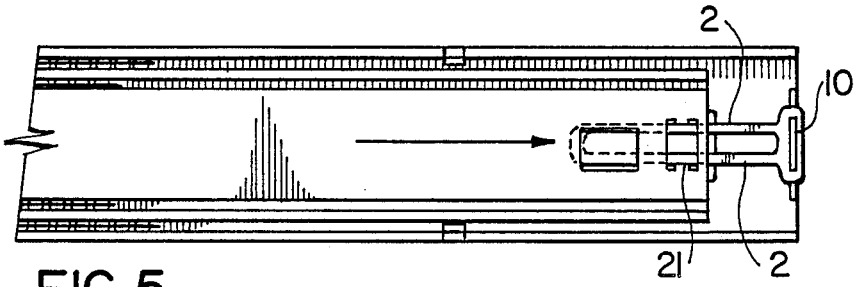
FIG. 5 is a top view of the three part slide wherein the mid point of the anti-rebound device is positioned between the two projections of the inner slide.
Figure 6:
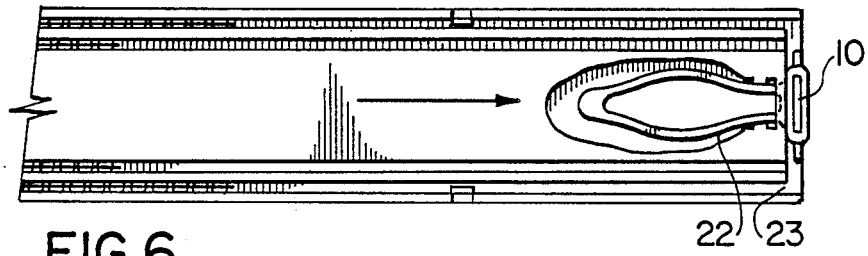
FIG. 6 shows the three part slide in complete closure.

In FIGS. 4, 5 and 6 the three part drawer slide is shown in various positions of closure. Line No. 19 shows a position of the drawer slide where the lance tabs 17 are approaching the front end of the anti-rebound device. Line 20 shows the entry of the tapered front end of the anti-rebound device between the two lance tabs. Line 21 is the point of maximum deflection where the lance tabs are located approximately halfway along the resilient sides 2 of the anti-rebound device 1. Line 22 illustrates an exit resistance position whereupon the drawer tends to be pulled inwardly by the resiliency of the anti-rebound device. Finally line 23 shows the full closure position.

Figure 7:
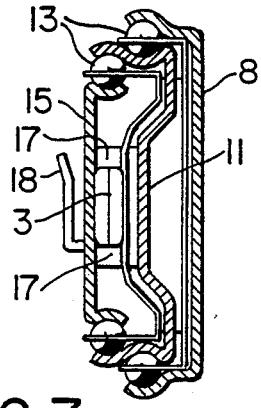
FIG. 7 is an end view of a three part slide in the closed position.

FIG. 7 is an end view of the drawer slide in the closed position. The three slides channel 8, 11 and 15 are shown. Upturned end flange 10 of the outer base channel and rear end 4 of the anti-rebound device 1 is also shown.

Figure 8:
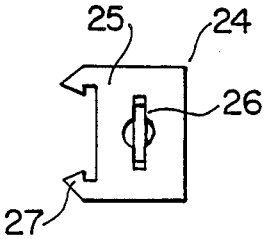
FIG. 8 shows an alternative embodiment of the three part side using a latch rather than a rebound mechanism.

FIG. 8 is a side view of an alternative embodiment, showing the latching device 24 having a body 25. An elongate slot 26 can be fitted over lance tabs 17 and two protruding front hook members 27 engage end flange 10.

Figure 9:
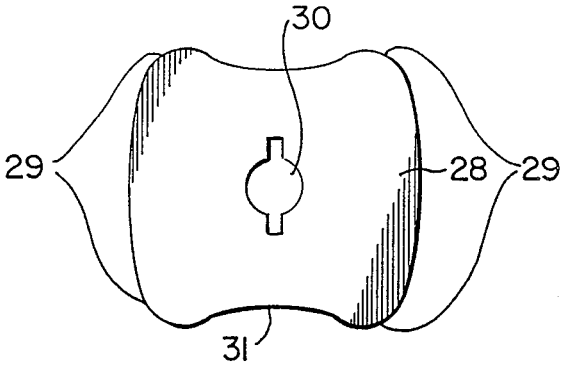
FIG. 9 is a top view of an energy absorbing bumper.

FIG. 9 is an energy absorbing bumper 28 with friction surfaces 29 and mounting hole cavity 30 to accept standing lance tab 33 and detent area 31.

Figure 10:
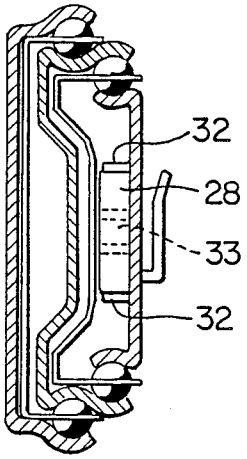
FIG. 10 is an end view of the three part slide viewed from the opposite end of the anti-rebound device.

FIG. 10 is an end view of a three part slide looking from the opposite end of the anti-rebound device. Shown is the energy absorbing urethane bumper 28 mounted to intermediate channel 11 on standing lance tab 33. Downwardly directed lance tabs 32 on small channel 15 project into detent area 31 of bumper 28.

It is understood the invention is not restricted to the particular description of the embodiment described herein, but extends to all configurations of anti-rebound devices which use resilient members within drawer slides.

What I claim as my invention is:

1. A drawer slide comprising at least two slide channels, each of said slide channels having flanged sides, first and second channel ends, and a web, said slide channels being adapted to slide one within another as said drawer slide moves between an open position and a closed position, said first channel ends being adjacent and said second channel ends being adjacent when said drawer slide is in said closed position, a first one of said slide channels having fastening means near one of said channel ends and a second one of said slide channels having projection means near a said adjacent channel end; and resiliently deflectable anti-rebound means mounted on said fastening means, said anti-rebound means comprising an elongate member having resilient sides, said resilient sides diverging from a first end to a point of maximum width, said first end having a mounting means for mounting said anti-rebound means on said fastening means, and said resilient sides converging towards a tapered second end, said tapered second end adapted to engage said projection means; wherein in operation, said anti-rebound means is adapted to engage and be resiliently deflected by said projection means, such that when drawer slide moves between an open position and a closed position said anti-rebound means resists both closure and reopening.

2. A drawer slide as claimed in claim 1 wherein said at least two slide channels comprise an inner slide channel, an intermediate slide channel, and an outer base slide channel, wherein said fastening means comprises a substantially 90° upturned flange member, and said projection means comprises two substantially 90° downturned projections, positioned at a distance apart from one another near the adjacent end of said inner slide channel; wherein, in operation, said two downturned projections are adapted to engage and resiliently deflect said anti-rebound means upon closing and reopening said drawer slide.

3. A drawer slide as claimed in claim 2 wherein said anti-rebound means is positioned between said inner channel web and said intermediate channel.

4. A drawer slide as claimed in claim 1 wherein said resilient sides of said anti-rebound means are curvilinear, and are adapted to be compressed to a width similar to the said distance between said two downturned projections.

5. A drawer slide as claimed in claim 4 wherein said sides of said anti-rebound means have differing sectional sizes along their length; said sides decreasing in sectional size from the approximate midpoint towards each end.

6. A drawer slide as claimed in claim 1 wherein said mounting means is a slotted aperture extending transversely to the longitudinal axis of the anti-rebound means.

7. A drawer slide as claimed in claim 1 wherein, when said projection means reach a point midway the length of said elongate member, the greatest amount of resistance to opening and closing of the drawer slide occurs.

8. A drawer slide as claimed in claim 1 wherein said antirebound means is constructed of polymerized resins.

* * * * *